US011006753B2

(12) United States Patent
Carrera

(10) Patent No.: US 11,006,753 B2
(45) Date of Patent: May 18, 2021

(54) ARMCHAIR

(71) Applicant: CIAR S.P.A., Pesaro (IT)

(72) Inventor: Massimo Carrera, Pesaro (IT)

(73) Assignee: CIAR S.P.A., Pesaro (IT)

( * ) Notice: Subject to any disclaimer, the term of this patent is extended or adjusted under 35 U.S.C. 154(b) by 0 days.

(21) Appl. No.: 16/742,174

(22) Filed: Jan. 14, 2020

(65) Prior Publication Data

US 2020/0221874 A1 Jul. 16, 2020

(30) Foreign Application Priority Data

Jan. 15, 2019 (DE) ..... 20 2019 100 213.1

(51) Int. Cl.

| | |
|---|---|
| ***A47C 1/03*** | (2006.01) |
| ***A47C 1/0355*** | (2013.01) |
| ***A47C 1/024*** | (2006.01) |
| ***A47C 7/50*** | (2006.01) |

(52) U.S. Cl.

CPC ..... *A47C 1/0355* (2013.01); *A47C 1/0242* (2013.01); *A47C 7/506* (2013.01)

(58) Field of Classification Search

CPC ..... A47C 1/0355; A47C 1/0242; A47C 1/035; A47C 1/034; A47C 1/031; A47C 1/024

USPC ..... 297/85 M, 83, 84

See application file for complete search history.

(56) References Cited

U.S. PATENT DOCUMENTS

| | | | | |
|---|---|---|---|---|
| 5,730,494 | A * | 3/1998 | LaPointe | A61G 5/14 297/330 |
| 2003/0122332 | A1* | 7/2003 | Engels | A61G 5/1078 280/47.38 |
| 2006/0061148 | A1* | 3/2006 | Pollard | A47C 31/008 297/85 M |
| 2009/0096255 | A1* | 4/2009 | Robertson | A47C 7/506 297/85 M |
| 2011/0248530 | A1* | 10/2011 | Sartisohn | A47C 1/034 297/83 |
| 2013/0175847 | A1* | 7/2013 | Lawson | A61G 5/14 297/85 M |

(Continued)

FOREIGN PATENT DOCUMENTS

| | | | |
|---|---|---|---|
| DE | 20000926 | | 3/2000 |
| DE | 10351457 | | 6/2005 |
| JP | H0838296 | * | 2/1996 |

OTHER PUBLICATIONS

Translation of JPH0838296 from Espacenet (Year: 2020).*

*Primary Examiner* — Mark R Wendell

(74) *Attorney, Agent, or Firm* — Renner Kenner Greive Bobak Taylor & Weber

(57) ABSTRACT

According to the invention, the armchair has a seat, supporting feet, a stand-up aid, and a chassis with wheels for moving the armchair. The chassis is adjustable relative to the supporting feet between at least a first and a second position, with the wheels being spaced apart in the first position of the footprint while the armchair is supported with the supporting feet on the footprint, and with the wheels being in rolling contact with the footprint in the second position while the supporting feet are arranged so as to be spaced apart from the footprint. The aid has an adjustment mechanism with a servomotor, with the adjustment mechanism being coupled with the chassis for the purpose of displacing the chassis by means of the servomotor between the first and second position.

10 Claims, 9 Drawing Sheets

(56) References Cited

U.S. PATENT DOCUMENTS

Figure 1:
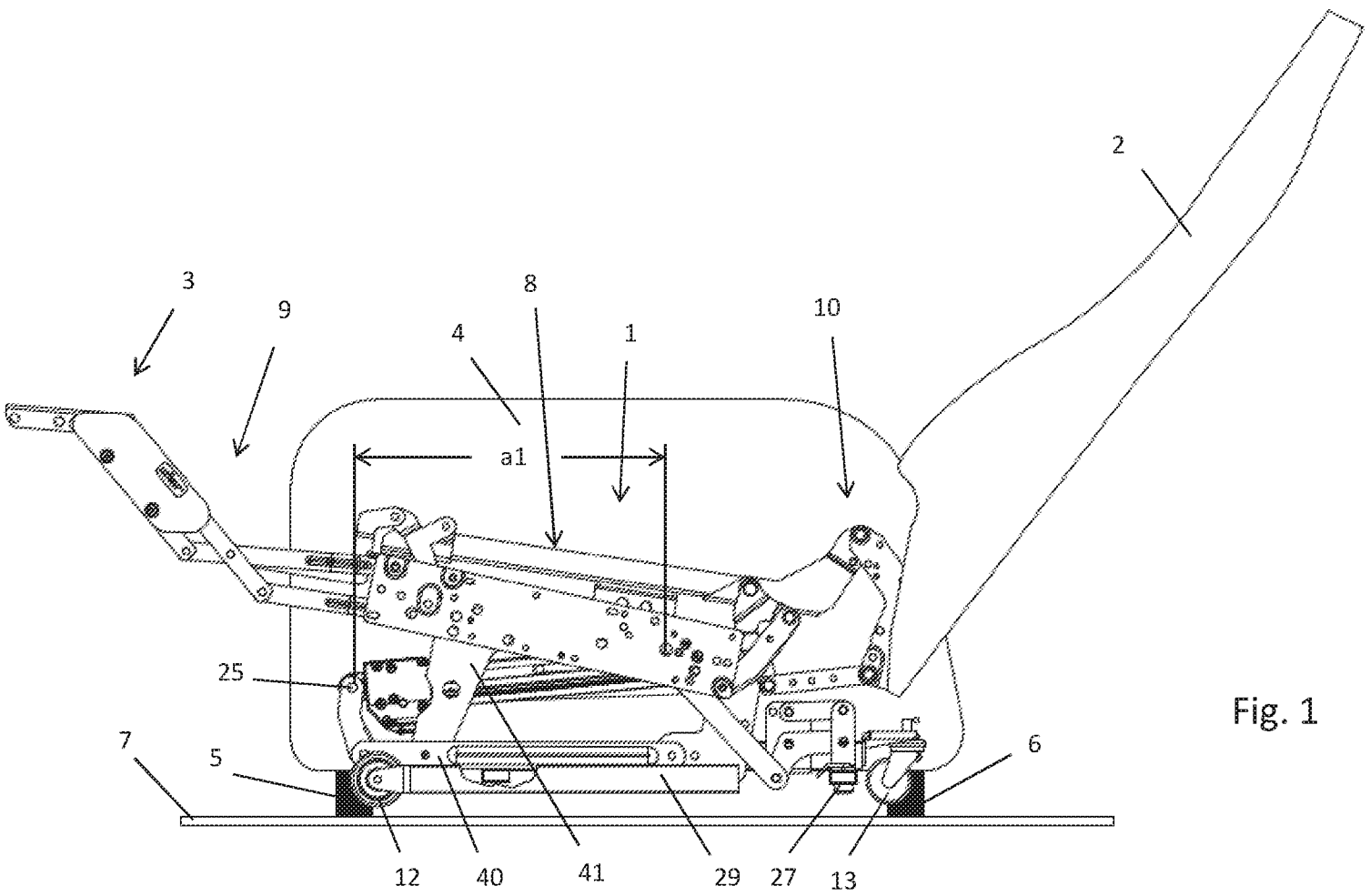

| | | | | |
|---|---|---|---|---|
| 2014/0265497 | A1* | 9/2014 | Hough | A61G 5/006<br>297/316 |
| 2018/0036189 | A1* | 2/2018 | Lingegard | A61G 7/1051 |
| 2018/0228290 | A1* | 8/2018 | Kiwak | A47C 1/0347 |

* cited by examiner

ARMCHAIR

The invention relates to an armchair with a stand-up aid.

The advantage of an armchair with a stand-up aid is that the armchair can be very easily tilted forward using a remote control or a control knob, thus enabling the user to lift himself very comfortably out of the cushions. This functionality is particularly easy on the back, since no sudden effort is required when standing up. However, this mechanism also makes it possible to sit down in a particularly gentle and comfortable manner.

Such armchairs are often embodied as so-called reclining chairs, which also offer the opportunity to tilt the backrest and extend a footrest. One or more servomotors are used to move the armchair into the various positions, with the consequence that the weight of such armchairs can be substantial. The armchair thus inevitably requires castors in order to be moved easily to another location. However, once the proper location for the armchair has been found, it is desirable if the wheels can be fixed in order to reliably prevent it from rolling away, especially when the stand-up aid is activated.

Nonetheless, such castors are often aesthetically unappealing, for which reason other constructions have been considered in which the armchair is usually on supporting feet and a chassis can be extended only in the event that the armchair is to be moved. But this solution, too, requires additional investment in the upholstery in the region of the backrest in order to achieve satisfactory aesthetic impressions. In addition, the operation of the pedal requires a certain amount of force that cannot be mustered by older people in some circumstances. Last but not least, the chassis that can be extended by means of a foot pedal results in added costs.

An armchair with a stand-up aid is known from WO 96/39895 A that is supported in a home position by four wheels on the footprint. Upon actuation of the stand-up aid, an anti-slip element is extended to the footprint by means of a lifting linkage, which raises the front wheels while being simultaneously supported on the footprint, thus ensuring a fixed positioning of the armchair. In order to prevent the armchair from accidentally rolling away when all of the rollers are in contact with the footprint, at least some rollers are equipped with a brake.

The invention is based on the object of improving the armchair with stand-up aid in terms of its ease of use.

According to the invention, this object is achieved by the features of claim 1, in which the armchair has a seat, supporting feet, a stand-up aid, and a chassis with wheels for moving the armchair. The chassis is adjustable relative to the supporting feet between at least a first and a second position, with the wheels being spaced apart in the first position of the footprint while the armchair is supported with the supporting feet on the footprint, and with the wheels being in rolling contact with the footprint in the second position while the supporting feet are arranged so as to be spaced apart from the footprint. The aid has an adjustment mechanism with a servomotor, with the adjustment mechanism being coupled with the chassis for the purpose of displacing the chassis by means of the servomotor between the first and second position.

The provision of supporting feet ensures that the armchair stands securely when the supporting feet are supported on the footprint. Through activation of the servomotor, the wheels of the chassis come into rolling contact with the footprint, thus enabling the armchair to be easily moved to another location. It is not necessary for brakes on the rollers to be additionally released for this purpose. The retraction and raising of the chassis also has the advantage that the wheels do not tarnish the overall aesthetic appearance of the armchair when they are not needed.

Additional advantages and embodiments of the invention constitute the subject matter of the subclaims.

According to another embodiment of the invention, the seat has a seat frame mechanism that is fixed to side walls of the armchair. Moreover, the adjustment mechanism can have at least one first lifting linkage and one second lifting linkage, in which case the first lifting linkage is hingedly coupled at a first end with the chassis and at a second end with the seat frame mechanism, and the second lifting linkage is also hingedly connected at a first end to the chassis, whereas the second end is in operative contact with the servomotor. The servomotor can thus be utilized both for the stand-up and for the operation of the chassis.

According to another embodiment of the invention, at least one additional, articulated interlink can be provided between the second end of the second lifting linkage and the servomotor, which enables the motion sequences to be improved. In another embodiment according to the invention, the chassis comprises at least one anti-slip element and can be moved therewith relative to the supporting feet into yet a third position, in which the armchair is supported on the anti-slip element and a portion of the wheels on the footprint while the remaining wheels as well as the supporting feet are arranged so as to be spaced apart from the footprint. It is especially advantageous in this regard if the anti-slip element is coupled via a linkage mechanism with the chassis and the adjustment mechanism. It is expedient in this case if the linkage mechanism of the anti-slip element is hingedly coupled with the first lifting linkage of the adjustment mechanism.

Moreover, it is especially user-friendly if the chassis is coupled with the servomotor via the adjustment mechanism for the motorized displacement of the chassis into the first, second, and third position.

In addition to the stand-up aid and the possibility of moving the armchair by means of the wheels, the armchair advantageously also has a footrest that is connected to the seat frame mechanism via a footrest adjustment mechanism for extending and retracting the footrest. Furthermore, a backrest is provided that can be adjusted with a backrest adjustment mechanism in order to move the seat and backrest between an upright home position and a reclined position. If, in addition, the footrest adjustment mechanism and the backrest adjustment mechanism are coupled with the servomotor, both the reclined position and the home position, as well as the stand-up aid and the extension of the chassis can be implemented in an especially cost-effective manner with one and the same motor.

Figure 2:
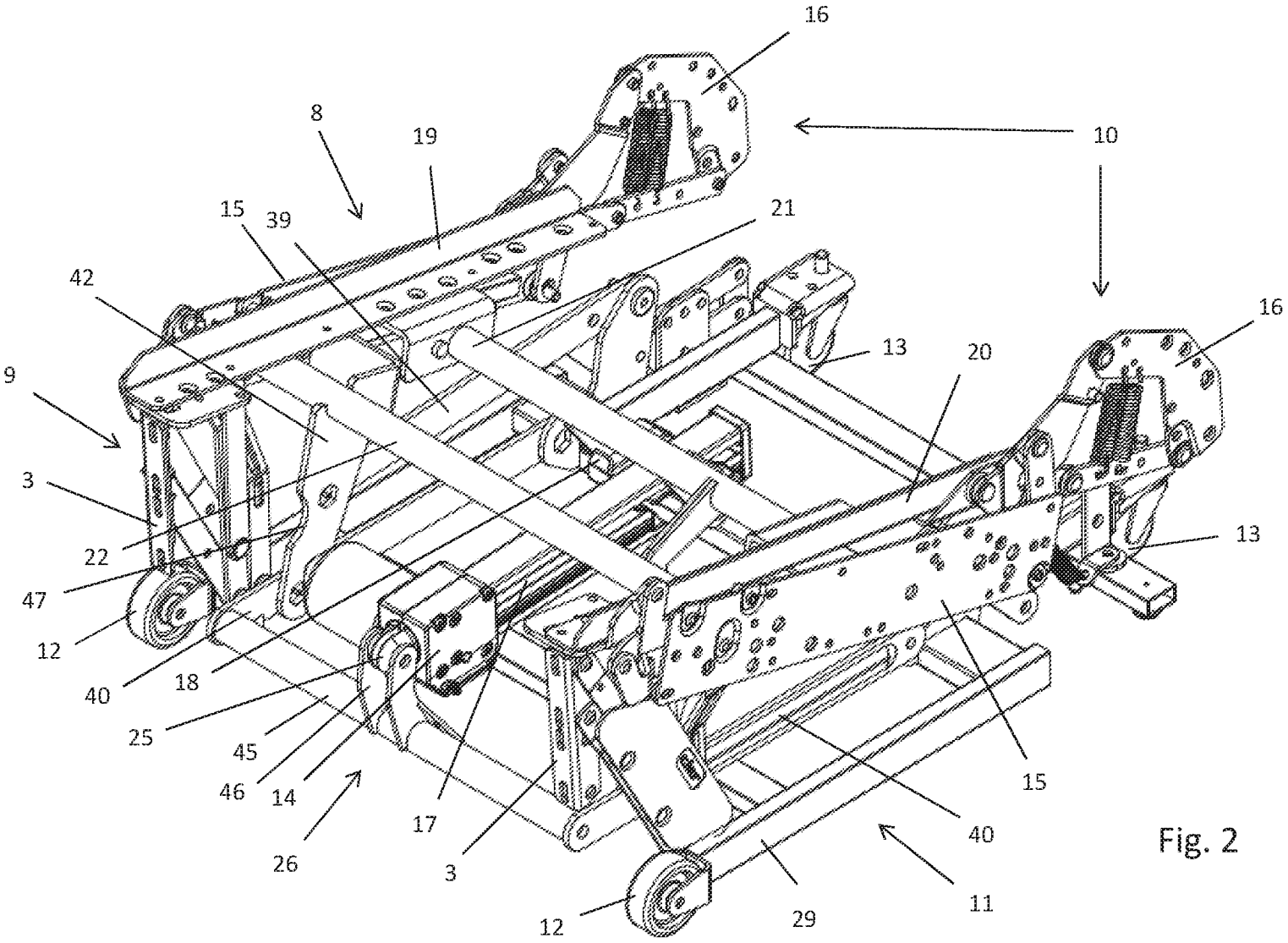
Figure 3:
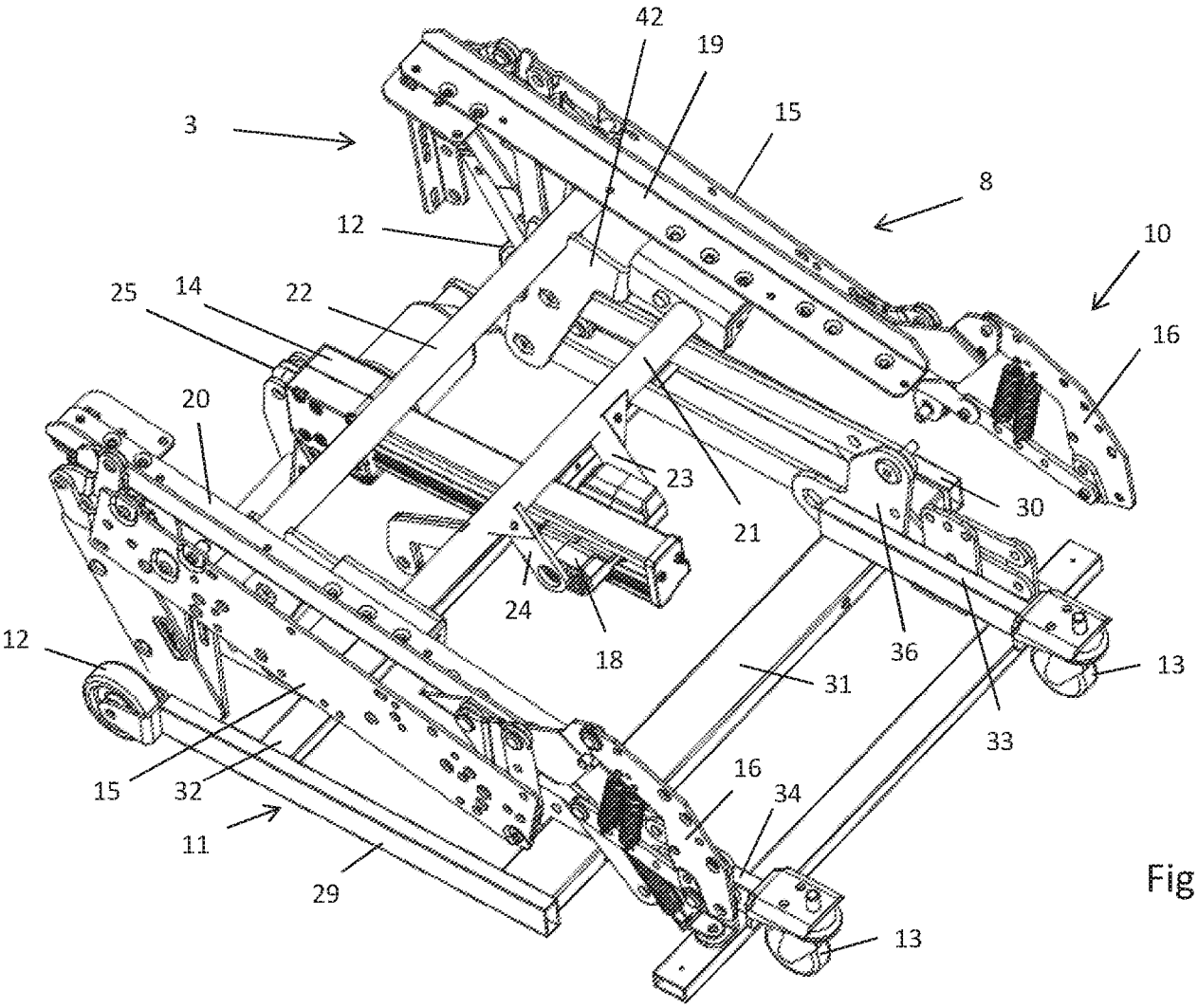
Figure 4:
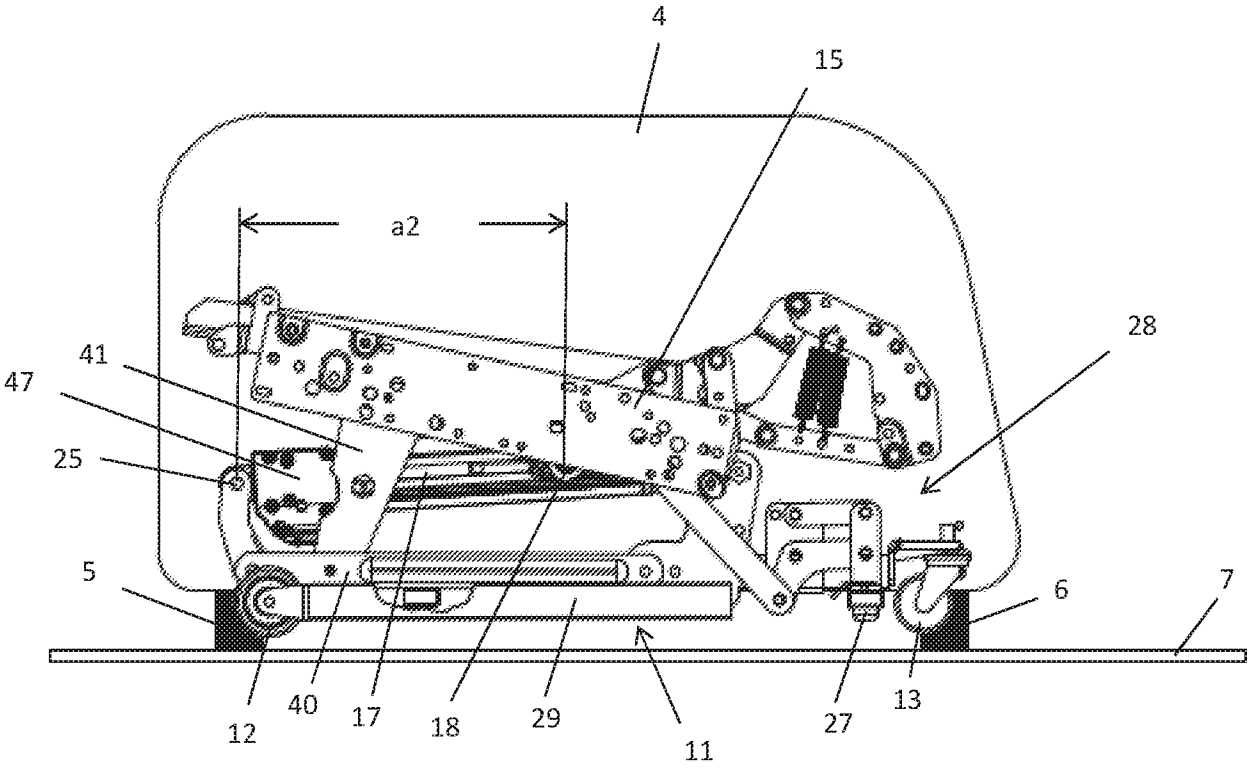
Figure 5:
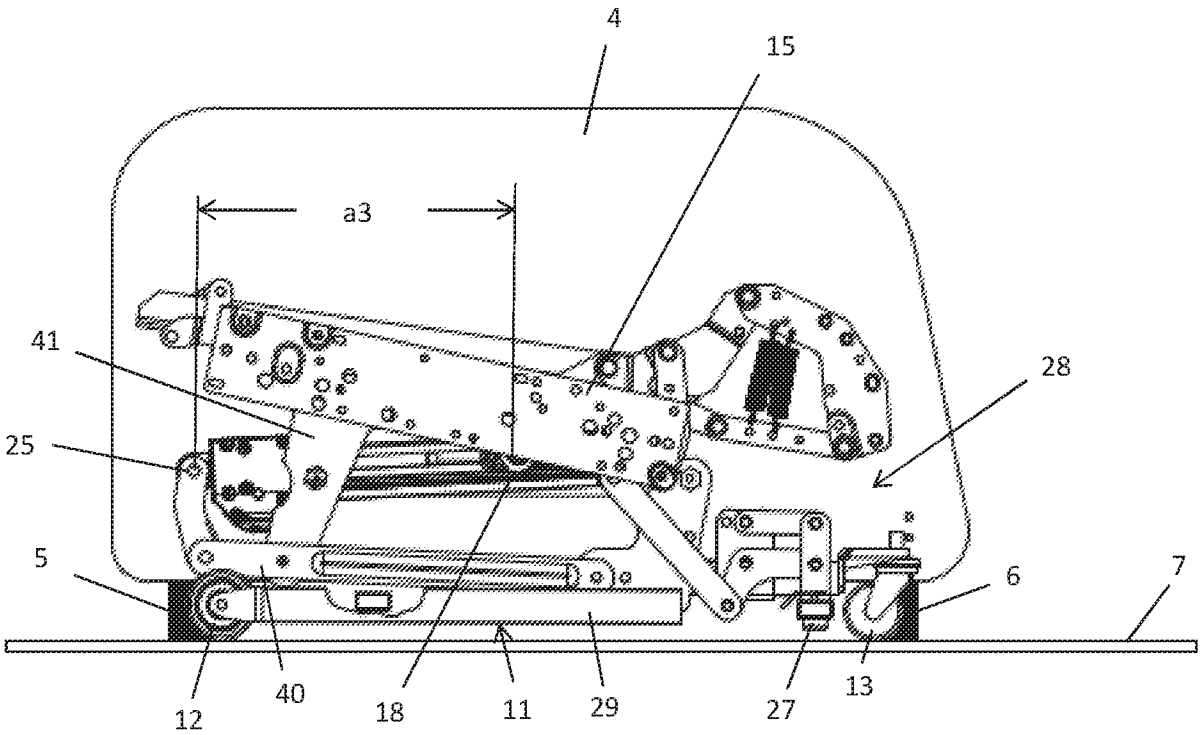
Figure 6:
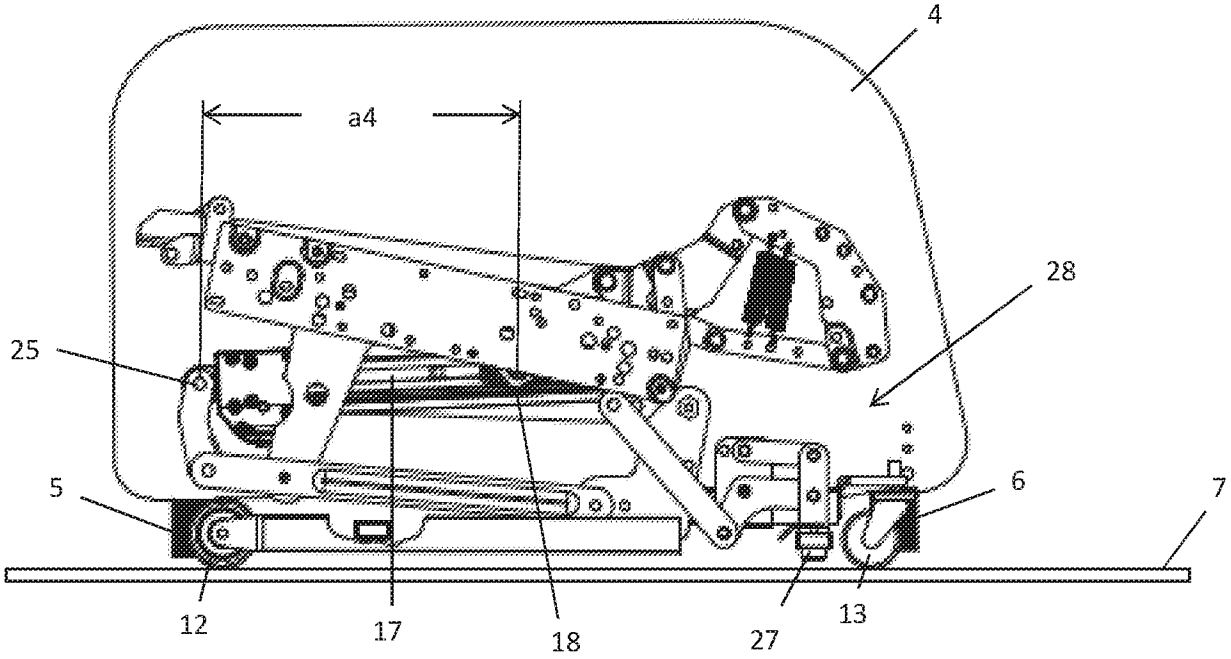
Figure 7:
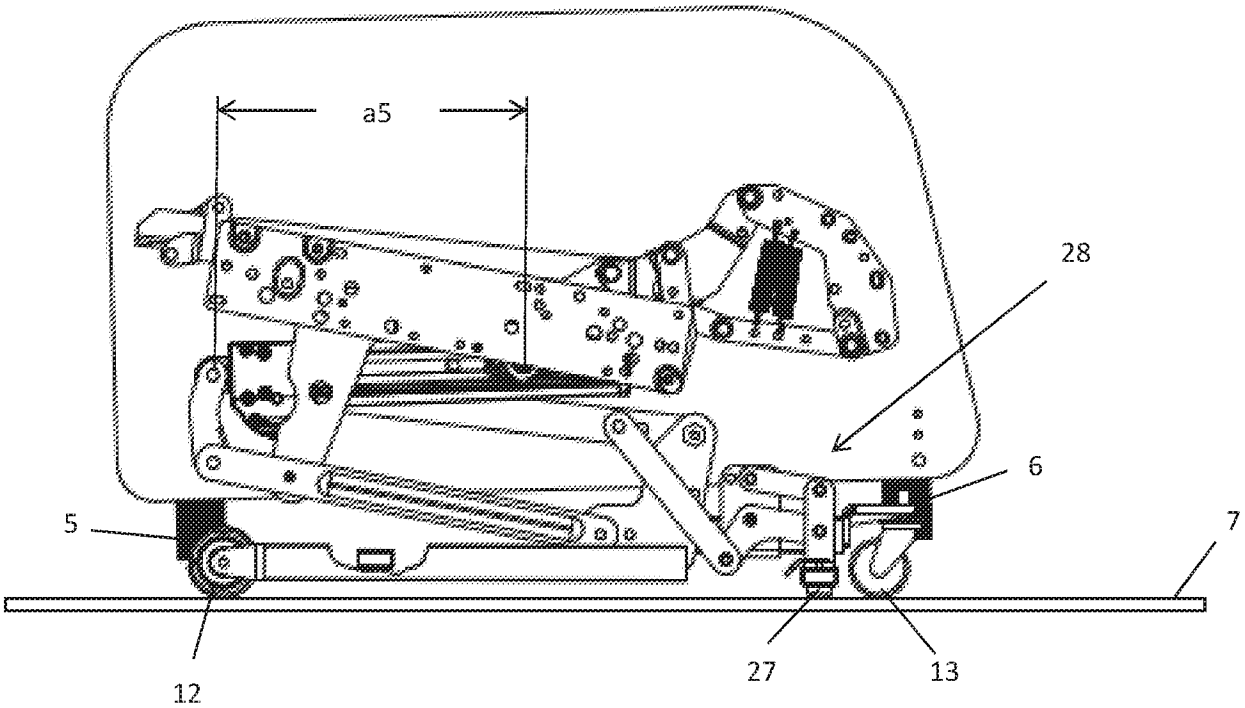
Figure 8:
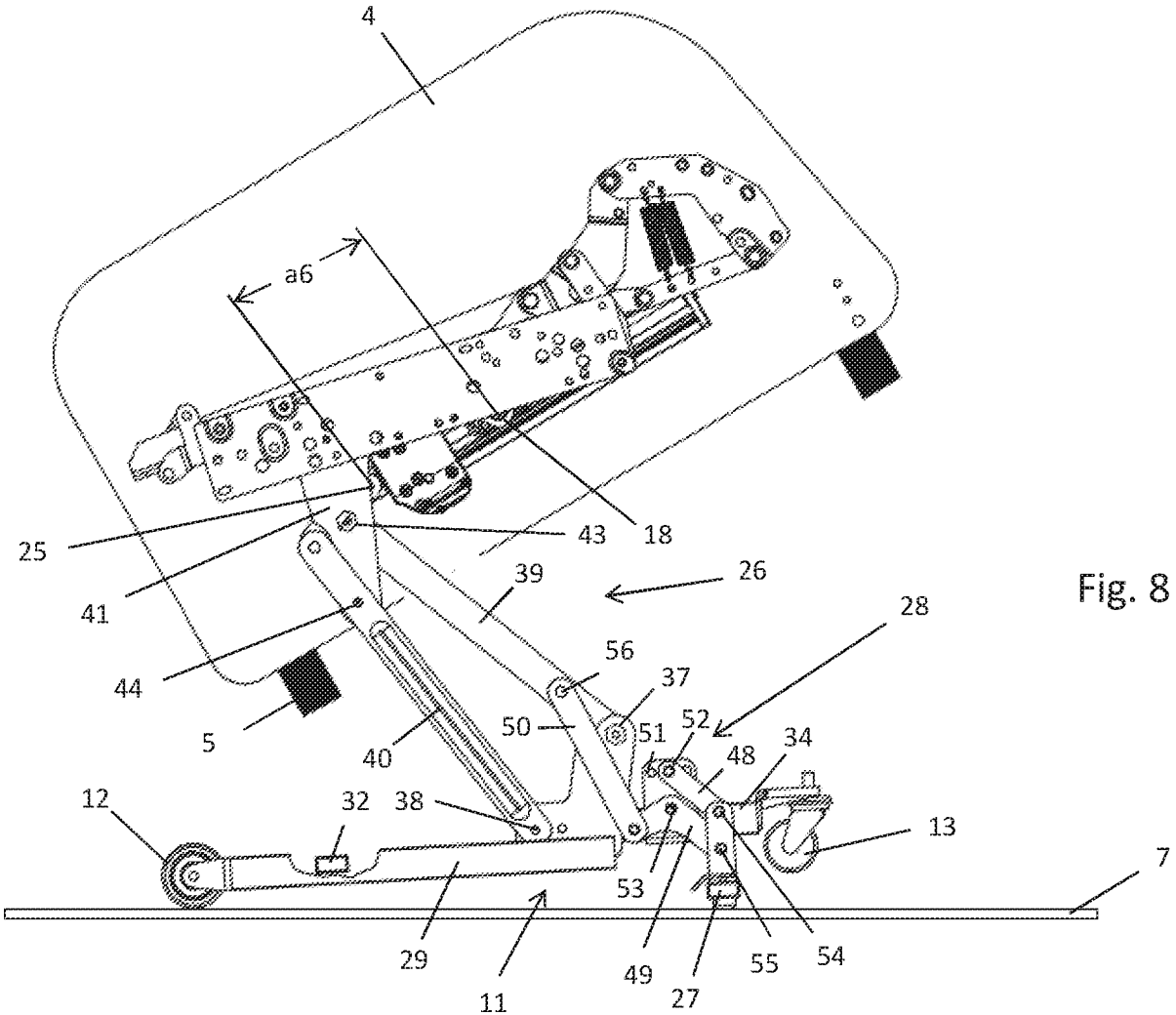
Figure 9:
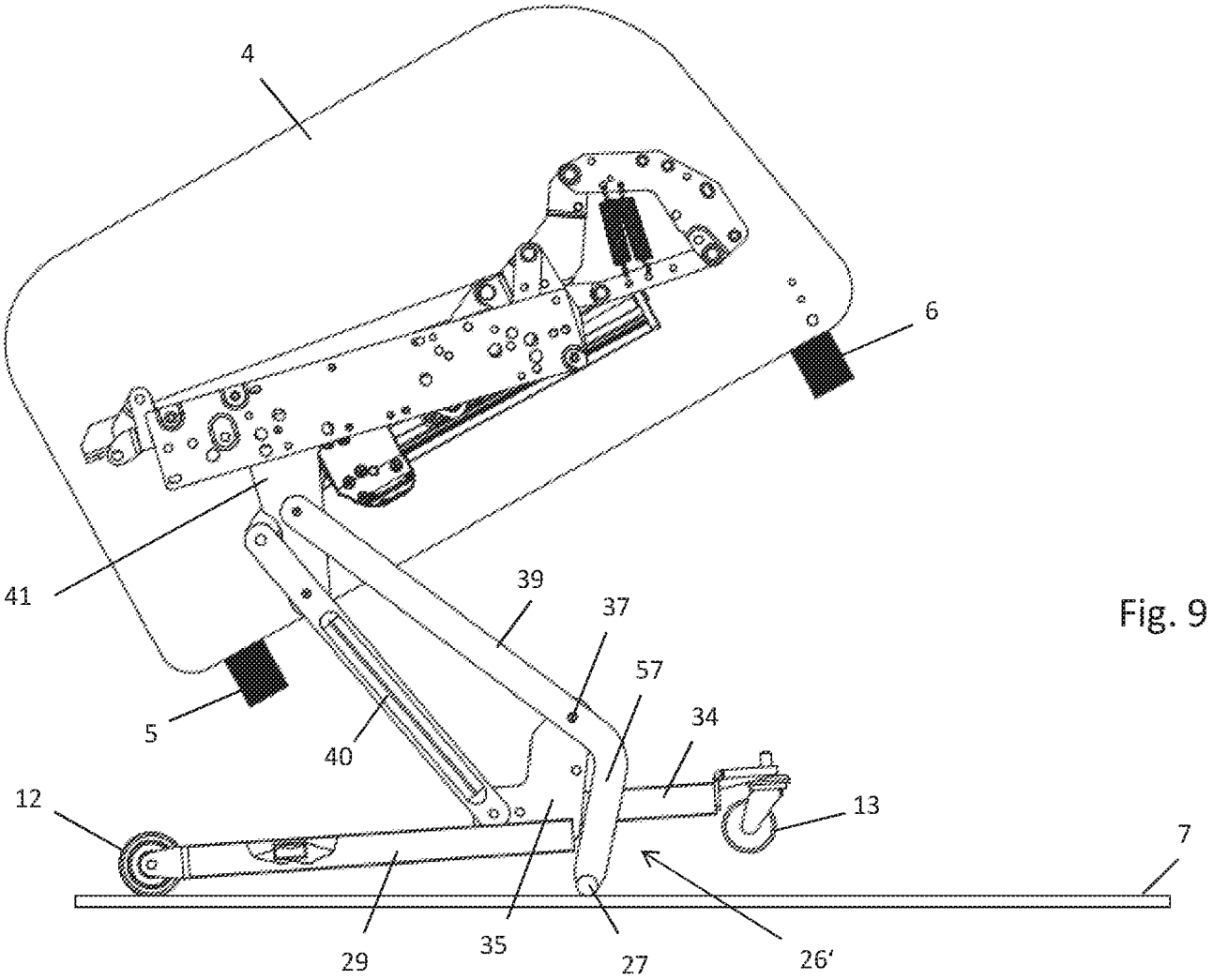

Additional advantages and embodiments of the invention are explained in greater detail in the description of an exemplary embodiment and the drawing:

In the drawing:

FIG. 1 shows a side view of the armchair according to the invention in the reclined position, FIG. 2 shows a first three-dimensional representation of the armchair mechanics obliquely from the front, FIG. 3 shows a second three-dimensional representation of the armchair mechanics obliquely from the rear, FIG. 4 shows a simplified side view of the armchair according to the invention with the chassis raised, FIG. 5 shows a simplified side view of the armchair according to the invention with the chassis lowered, FIG. 6 shows a simplified side view of the armchair according to the invention in the moving position, FIG. 7 shows a simplified side view of the armchair according to the invention in a position with lowered anti-slip element, FIG. 8 shows a simplified side view of the armchair according to the invention in the raised position of the armchair (stand-up aid activated), and FIG. 9 shows a simplified side view of the armchair according to the invention in the raised position of the armchair (stand-up aid activated) according to a second exemplary embodiment.

FIG. 1 shows the armchair according to the invention in its reclined position. It has a seat 1, a backrest 2, and a footrest 3. The armchair also provides for two side walls 4 that laterally bound the seat 1 and also serve as armrests. Furthermore, the armchair has front and rear supporting feet 5, 6, with which the armchair is supported on a footprint 7 in the depicted reclined position. The seat 1 also has a seat frame mechanism 8 with which are coupled a footrest adjustment mechanism 9 for extending and retracting the footrest 3 and a backrest adjustment mechanism 10 for adjusting the seat 1 and backrest 2 between an upright home position and the reclined relaxed position shown in FIG. 1. The upholstery of the seat and footrest have been omitted in the illustration in order to better depict the armchair mechanics.

FIGS. 2 and 3 show three-dimensional representations of the armchair mechanics from different perspectives. It consists essentially of the seat frame mechanism 8, the footrest adjustment mechanism 9, and the backrest adjustment mechanism 10. A chassis 11 with front wheels 12 and rear wheels 13 is also provided. For motorized actuation of the armchair mechanics, a linear actuator with a servomotor 14 is provided. All of the armchair mechanics are bolted to the side walls 4 by means of two side plates 15 of the seat frame mechanism 8. The backrest, in turn, is fixed to two backrest support elements 16 of the backrest adjustment mechanism 10.

In addition to the servomotor 14, the linear actuator has a spindle 17 and a nut 18 that cooperates with the spindle 17. The servomotor 14 rotates the spindle in the respectively desired direction of rotation, thus causing a linear displacement of the nut 18 along the spindle.

The seat frame mechanism 8 has two laterally opposing seat frame parts 19, 20 to which the actual seat 2 is fastened along with its upholstery. The seat frame parts 19, 20 are rigidly interconnected by means of a first cross-brace 21 and a second cross-brace 22, with the first cross-brace 21 having two tongues 23, 24 that are arranged in a torque-proof manner in the center thereof and hingedly coupled with the nut 18 (FIG. 3).

At the motor end of the linear actuator, a coupling lug 25 is provided for coupling an adjustment mechanism 26, which will be explained in greater detail below with reference to FIGS. 4 to 8, which show different positions of the armchair that can be achieved through displacement of the nut 18 along the spindle 17. In other words, each position of the armchair is defined by a characteristic distance between the coupling lug 25 and the nut 18. By actuating the servomotor 14, the nut 18 can be moved along the spindle to the respective desired distance from the coupling lug 25 at which the armchair assumes the position that is associated with the distance.

In the reclined position according to FIG. 1, the nut 18 assumes the greatest distance a1 from the coupling lug 25. An actuation of the servomotor so as to shorten this distance causes a retraction of the footrest and an adjustment of the seat 1 and backrest 2 into an upright home position. The design of the seat mechanism that is required for this purpose is well known to a person skilled in the art, so it will not be discussed in any more detail below.

The upright home position of the seat mechanism is shown in FIG. 4. For the sake of clarity, the backrest 2 and the footrest 3 as well as the footrest adjustment mechanism 9 have been omitted here. In this position, the distance between the nut 18 of the coupling lug 25 is now only a2. In this home position of the armchair, the armchair is supported by its supporting feet 5, 6 on the footprint 7. On the other hand, the chassis 11 is in a first, retracted or raised position in which the front wheels 12 and the rear wheels 13 are arranged so as to be spaced apart from the footprint 7. Through appropriate configuration of the armchair cover, the wheels 12, 13 can be concealed such that possibly only the supporting feet 5, 6 are visible.

If the distance of the nut 18 from the coupling lug 25 is further shortened by means of the servomotor 14 to the distance a2 (FIG. 5), the chassis 11 is lowered onto the footprint 7, so that both the supporting feet 5, 6 as well as the front wheels 12 and the rear wheels 13 are in contact with the footprint 7.

If the distance is shortened further to the distance a4 of FIG. 6, the seat mechanism causes a lifting of the supporting feet 5, 6, so that the armchair is supported on the footprint 7 only on the wheels 12, 13 of the chassis 11. This second position of the chassis also represents the moving position of the armchair in which the armchair can be easily moved using the wheels. In order to ensure good maneuverability of the armchair, it is expedient if the rear wheels 13 are embodied as castors so that they can rotate about a vertical axis.

If the servomotor 14 is actuated so as to further shorten the distance between the nut 18 and the coupling lug 25 to the distance a5 according to FIG. 7, an anti-slip element 27 is lowered onto the contact surface 7 by means of a linkage mechanism 28. If the distance between nut 18 and coupling lug 25 is then reduced even further, the stand-up auxiliary function is activated by lifting the seat into a raised and forward-inclined position according to FIG. 8. The resulting distance a6 represents the smallest distance between the nut 18 and coupling lug 25. The shortening of the distance a5 to the distance a6 thus causes a further extension of the anti-slip element 27, so that the rear wheels 13 lift off the footprint 7 while the front wheels 12 remain in contact with the footprint 7 and thus form a swivel axis for the chassis 11.

In the raised position according to FIG. 8, the seat 1 has moved slightly upwards and inclined slightly forward, so that standing up or sitting down is made substantially easier for a user. The anti-slip element is provided with a suitable anti-slip coating that reliably ensures that the armchair stands securely and, in particular, does not inadvertently slip on the footprint 7. In order to increase the stability, the front wheels 12 should not be embodied as castors.

The configuration of the chassis 11 can be seen particularly well in FIGS. 3 and 8. It comprises substantially two lateral frame parts 29, 30, a rear cross-connecting part 31 and a front cross-connecting part 32, wherein the front wheels 12 being fastened to the front ends of the lateral frame parts 29, 30. Each of the rear wheels 13 is attached to first and second arms 33, 34, respectively, with the two arms each extending rearward from the rear cross-connecting part 31.

In the vicinity of the rear cross-connecting part 31, two spaced-apart mounting flanges 35, 36 are further provided which are rigidly connected to the rear cross-connecting part 31 and provide a first coupling point 37 and a second coupling point 38, respectively, with which the adjustment mechanism 26 of the stand-up aid is hingedly coupled. In the depicted exemplary embodiment, this adjustment mechanism 26 has a first lifting linkage 39 and a second lifting linkage 40 on either side, respectively.

The seat frame mechanism 8 also provides a first coupling element 41 and a second coupling element 42, each of which is rigidly connected to the first and second seat frame part 19, 20, respectively and to the second cross-brace 22, so that the two coupling elements 41, 42 project downward quasi obliquely from the first and second seat frame part, respectively. The first lifting linkage 39 is hinged on its first end at the first coupling point 37 of the mounting flange 35 or 36 and with its second end at a first articulation point 43 of the first and second coupling element 41, 42, respectively. The second lifting linkage 40, in turn, is hingedly connected at a first end to the second coupling point 38 of the mounting flange 35 and 36 and coupled in a central region with a second articulation point 44 of the first and second coupling element 41, 42, respectively. Both the first lifting linkage 39 and the second lifting linkage 40 are thus provided on the sides of the armchair.

The respective second ends of the second lifting linkages 40 are pivotally interconnected by means of a rod-like interlink 45, with the interlink 45 being hingedly coupled with the coupling lug 25 in a central region by means of two arms 46 that are connected in a torque-proof manner thereto. The first and second coupling elements 41, 42 have recesses 47 on their forward-facing front edges that come into contact with the rod-shaped interlink 45 during the lifting of the armchair between the positions shown in FIGS. 7 and 8 shortly before completion of the movement, thus reinforcing the inclined movement of the seat forward in the further course of the movement.

The functionality of the linkage mechanism 28 for actuating the anti-slip element 27 will be explained in greater detail below with reference to FIG. 8. The illustrated linkage mechanism 28 consists substantially of a first linkage part 48, a second linkage part 49, and a third linkage part 50. A coupling plate 51 is fastened to the first arm 33 and the second arm 34, respectively, that provides a first articulation point 52 for the first linkage part 48 and a second articulation point 53 for the second linkage part 49. The first linkage part 48 is coupled at one end with the first articulation point 52 and at the second end with a third articulation point 54 on the anti-skid element. The second linkage part 49 is hingedly coupled with the coupling plate 51 in a central region at the second articulation point 53 and hingedly connected at a first end to a fourth articulation point 55 on the anti-slip element 27. The second end of the second linkage part 49 is hingedly coupled with the third linkage part 50 which, in turn, is hingedly connected at its other end to a fifth articulation point 56 to the first lifting linkage 39. With this linkage mechanism 28, the anti-slip element 27 is extended according to FIG. 7 and FIG. 8 when the first lifting linkage 39 is raised and is increasingly supported on the footprint 7, so that the rear wheels 13 are lifted from the footprint 7.

The armchair mechanics described above thus require only one servomotor 14 to reach all of the positions of the armchair. As will readily be understood, however, it is not excluded from the scope of the invention for an additional motor to be provided in order to be able to approach additional positions of the armchair as desired. The armchair is adjusted by means of a remote control or a control panel that is recessed in the armrest, with only four buttons being ultimately required in order to move to the positions of the armchair that are relevant to the user.

Button 1: Upright home position according to FIG. 4
Button 2: Reclined position according to FIG. 1
Button 3: Moving position according to FIG. 6
Button 4: Raised position according to FIG. 8

The positions shown in FIGS. 5 and 7 do not represent independently approachable positions, but rather are assumed during the movement from the upright home position to the moving position or from the moving position to the raised position without pauses in the movement of the armchair.

The armchair mechanics described with reference to FIGS. 1 to 8 merely show a preferred exemplary embodiment. For instance, it is also possible for the adjustment mechanism of the stand-up aid and the linkage mechanism of the anti-slip element to be configured differently. FIG. 9 shows an example of a simplified adjustment mechanism 26' with a simple design that is characterized in that the first lifting linkage 39 of the adjustment mechanism 26 is simply extended further at the first coupling point 27 on the mounting flange 35 and 36 and bent downwards, bearing the anti-slip element 27 on its end. This solution thus requires substantially fewer articulation points and components and is therefore more economical. One tradeoff, however, is that the chair moves slightly backward during the movement between the position shown in FIG. 7 and the position shown in FIG. 8, since the distance between the front wheels 12 and the anti-slip element that is placed on the footprint 7 is shortened during the lifting operation.

The invention claimed is:

1. An armchair comprising:

a. a seat, b. supporting feet with which the armchair is supported in a home position on a footprint, c. a stand-up aid for lifting the seat from the home position to a raised position, wherein the stand-up aid has an adjustment mechanism with a servomotor, the servomotor serving to lift the seat, and d. a chassis with wheels for moving the armchair, wherein e. the chassis is adjustable relative to the supporting feet between at least a first and a second position, with the wheels being spaced apart in the first position of the footprint while the armchair is supported with the supporting feet on the footprint, and with the wheels being in rolling contact with the footprint in the second position while the supporting feet are arranged so as to be spaced apart from the footprint, and f. the adjustment mechanism of the stand-up aid is coupled with the chassis for the purpose of displacing the chassis by means of the servomotor between the first and second position.

2. The armchair as set forth in claim 1, characterized in that the seat has a seat frame mechanism that is fastened to side walls of the armchair.

3. The armchair as set forth in claim 2, characterized in that the adjustment mechanism has at least a first lifting linkage and a second lifting linkage, wherein the first lifting linkage is hingedly coupled at a first end with the chassis and at a second end with the seat frame mechanism, and the second lifting linkage is hingedly coupled at a first end with the chassis and is in operative contact at the second end with the servomotor.

4. The armchair as set forth in claim 1, characterized in that the armchair further comprises a footrest and a backrest that are coupled with a seat frame mechanism via a footrest adjustment mechanism for extending and retracting the footrest, and a backrest adjustment mechanism for adjusting the seat and backrest between an upright and a reclined position.

5. The armchair as set forth in claim 4, characterized in that the footrest adjustment mechanism and the backrest adjustment mechanism are coupled with the servomotor for the purpose of extending and retracting the footrest and of adjusting the seat and backrest.

6. An armchair comprising:

a seat having a seat frame mechanism that is fastened to side walls of the armchair, supporting feet with which the armchair is supported in a home position on a footprint, a stand-up aid for lifting the seat from the home position to a raised position, wherein the stand-up aid has an adjustment mechanism with a servomotor, and a chassis with wheels for moving the armchair, wherein the chassis is adjustable relative to the supporting feet between at least a first and a second position, with the wheels being spaced apart in the first position of the footprint while the armchair is supported with the supporting feet on the footprint, and with the wheels being in rolling contact with the footprint in the second position while the supporting feet are arranged so as to be spaced apart from the footprint, and the adjustment mechanism of the stand-up aid is coupled with the chassis for the purpose of displacing the chassis by means of the servomotor between the first and second position, characterized in that the adjustment mechanism has at least a first lifting linkage and a second lifting linkage, wherein the first lifting linkage is hingedly coupled at a first end with the chassis and at a second end with the seat frame mechanism, and the second lifting linkage is hingedly coupled at a first end with the chassis and is in operative contact at the second end with the servomotor, and further characterized in that at least one additional, hingedly coupled interlink is provided between the second end of the second lifting link and the servomotor.

7. An armchair comprising:

a seat, supporting feet with which the armchair is supported in a home position on a footprint, a stand-up aid for lifting the seat from the home position to a raised position, wherein the stand-up aid has an adjustment mechanism with a servomotor, and a chassis with wheels for moving the armchair, wherein the chassis is adjustable relative to the supporting feet between at least a first and a second position, with the wheels being spaced apart in the first position of the footprint while the armchair is supported with the supporting feet on the footprint, and with the wheels being in rolling contact with the footprint in the second position while the supporting feet are arranged so as to be spaced apart from the footprint, and the adjustment mechanism of the stand-up aid is coupled with the chassis for the purpose of displacing the chassis by means of the servomotor between the first and second position, characterized in that the chassis comprises at least one anti-slip element and can be further displaced relative to the supporting feet into a third position in which the armchair is supported on the anti-slip element and a portion of the wheels on the footprint, while the remaining wheels are arranged so as to be spaced apart from the footprint.

8. The armchair as set forth in claim 7, characterized in that the anti-slip element is coupled via a linkage mechanism with the chassis and the adjustment mechanism.

9. The armchair as set forth in claim 8, characterized in that the linkage mechanism of the anti-slip element is hingedly connected to a first lifting linkage of the adjustment mechanism.

10. The armchair as set forth in claim 8, characterized in that the chassis is coupled with the servomotor via the adjustment mechanism for the motorized displacement of the chassis into the first, second, and third position.

* * * * *